United States Patent [19]

Corbin et al.

[11] Patent Number: 4,999,679

[45] Date of Patent: Mar. 12, 1991

[54] CLEANING APPARATUS WITH HOUSING AND BRUSH BIASED TO THE SAME MAGNITUDE AND POLARITY

[75] Inventors: Robert W. Corbin, Ontario; William E. Detwiler, Fairport; Steven E. Kolb, Penfield, all of N.Y.

[73] Assignee: Xerox Corporation, Stamford, Conn.

[21] Appl. No.: 445,246

[22] Filed: Dec. 4, 1989

[51] Int. Cl.[5] ..... G03G 21/00

[52] U.S. Cl. ..... 355/303

[58] Field of Search ..... 355/301, 303, 296, 298

[56] References Cited

U.S. PATENT DOCUMENTS

| | | | |
|---|---|---|---|
| 4,116,555 | 9/1978 | Young et al. | 355/15 |
| 4,134,673 | 1/1979 | Fisher | 355/15 |
| 4,183,655 | 1/1980 | Umahashi et al. | 355/3 TR |
| 4,479,709 | 10/1984 | Syukuri et al. | 355/15 |
| 4,530,595 | 7/1985 | Itaya et al. | 355/15 |
| 4,763,168 | 8/1988 | Lindblad | 355/15 |

FOREIGN PATENT DOCUMENTS

| | | | |
|---|---|---|---|
| 0116045 | 9/1981 | Japan | 355/301 |
| 0186777 | 10/1983 | Japan | 355/303 |
| 0128481 | 7/1985 | Japan | 355/303 |
| 0170879 | 9/1985 | Japan | 355/303 |
| 0107369 | 5/1986 | Japan | 355/303 |

*Primary Examiner*—Fred L. Braun
*Assistant Examiner*—William J. Royer
*Attorney, Agent, or Firm*—H. Fleischer; J. E. Beck; R. Zibelli

[57] ABSTRACT

An apparatus which cleans a photoconductive surface having residual charged particles of opposite polarities thereon. Oppositely electrically biased cleaning brushes remove particles from the photoconductive surface with each brush being located in the chamber of a different housing with each housing electrically biased to the same magnitude and polarity as the brush located within the housing. The particles are then attracted from the cleaning brushes to electrically biased detoning rolls.

1 Claim, 2 Drawing Sheets

Figure 1:
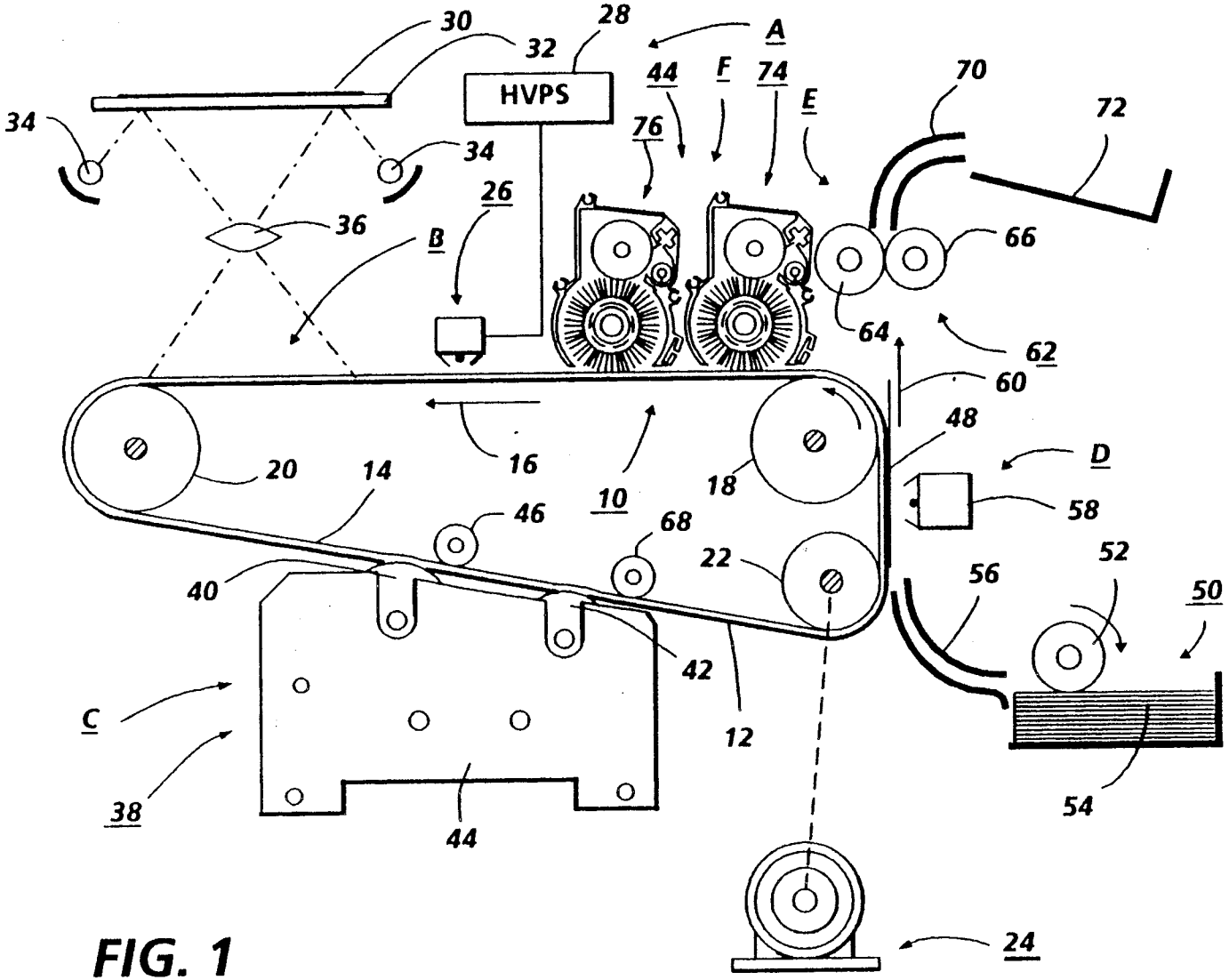

CLEANING APPARATUS WITH HOUSING AND BRUSH BIASED TO THE SAME MAGNITUDE AND POLARITY

This invention relates generally to an electrophotographic printing machine, and more particularly concerns an improved cleaning system for use therein.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive surface. After the electrostatic latent image is recorded on the photoconductive surface, the latent image is developed by bringing a developer mixture into contact therewith. A common type of developer material comprises carrier granules having toner particles adhering triboelectrically thereto. This two-component mixture is brought into contact with the photoconductive surface. Toner particles are attracted from the carrier granules to the latent image. This forms a toner powder image on the photoconductive surface which is subsequently transferred to a copy sheet. Finally, the toner powder image is heated to permanently fuse it to the copy sheet in image configuration.

Frequently, residual toner particles remain adhering to the photoconductive surface after the transfer of the developed image to the copy sheet. These residual toner particles may be "right sign toner", i.e. toner particles charged to a polarity which attracts the toner particle to the latent image, or "wrong sign toner", i.e. toner particles charged to a polarity which repels the toner particle from the latent image. All residual toner particles, both "right sign" and "wrong sign", should be cleaned from the photoconductive member. Hereinbefore, ordinary cleaning devices, such as webs, brushes, or foam rollers have not been entirely satisfactory in cleaning residual particles from the photoconductive surface. Recent developments in cleaning residual toner particles from a photoconductive surface have resulted in cleaning devices which, in addition to relying on physical contact, also use electrostatic fields to facilitate the removal of the toner particles from the photoconductive surface. It has been found that by establishing an electrostatic field between the photoconductive surface and the cleaning member enhances toner attraction to the cleaning member. One of the more attractive cleaning devices employs an electrically biased non-magnetic sleeve having a magnet disposed interiorly thereof. Magnetic carrier granules are attracted to the sleeve. As the sleeve rotates, these carrier granules attract the residual toner particles thereto. One of the problems associated with a cleaning device of this type is that toner particles of only one polarity, i.e. "right sign" or "wrong sign" toner particles, are attracted to the carrier granules. Only positive or negative toner particles are removed from the photoconductive surface. Under these circumstances, residual toner particles of one polarity will remain adhering to the photoconductive surface after cleaning. Typically, the cleaning device is designed to remove "right sign" toner particles from the photoconductive surface with "wrong sign" toner particles remaining thereon. Various types of cleaning devices have been used previous. The following disclosures appear to be relevant:

U.S. Pat. No. 4,116,555; Patentee: Young et al.; Issued: Sept. 26, 1978.

U.S. Pat. No. 4,134,673; Patentee: Fisher; Issued: Jan. 16, 1979.

U.S. Pat. No. 4,183,655; Patentee: Umahashi et al.; Issued: Jan. 15, 1980.

U.S. Pat. No. 4,479,709; Patentee: Syukuri et al.; Issued: Oct. 30, 1984.

U.S. Pat. No. 4,530,595; Patentee: Itaya et al.; Issued: July 23, 1985.

U.S. Pat. No. 4,763,168; Patentee: Lindblad; Issued: Aug. 9, 1988.

The relevant portions of the foregoing disclosures may be briefly summarized as follows:

U.S. Pat. No. 4,116,555 discloses an electrically biased magnetic brush used to remove background toner particles from a photoreceptor. Two reclaim rollers, which are biased electrically to opposite polarities, are used to remove toner particles from the magnetic brush. The use of opposite polarity rollers is to make certain that toner particles of opposite polarities are removed from the magnetic brush.

U.S. Pat. No. 4,134,673 describes a dual brush cleaning apparatus which has a symmetrical configuration. A first cleaning brush is is positioned in brushing engagement with an imaging surface. A second brush having a greater interference than the first brush, is in contact with the imaging surface.

U.S. Pat. No. 4,183,655 describes an electrically biased cleaning roll in engagement with a transfer roll. The cleaning roller is connected to either a positive or negative voltage source by a switch. During transfer, a bias voltage of opposite polarity to that of the toner is applied to the transfer roller through the cleaning roller. During cleaning, a bias voltage having the same polarity as the toner is applied to the cleaning roller.

U.S. Pat. No. 4,479,709 discloses an AC electrical bias on a DC carrier between a cleaning roller and an imaging member. The electrical bias causes toner to move from the imaging member to the cleaning roller.

U.S. Pat. No. 4,530,595 describes cleaning toner from an image holder by impressing a high voltage on a conductive layer of a belt shaped film. The impressed voltage is opposite in polarity to that of the toner.

U.S. Pat. No. 4,763,168 discloses a conductive fiber brush for cleaning residual toner from a photoconductive surface. A DC voltage is applied to the brush and has a polarity which attracts toner to the brush. Another DC voltage of opposite polarity to the first mentioned DC voltage is subsequently applied to the brush to detone the brush and deposit the toner on the photoconductive surface.

In accordance with one aspect of the present invention, there is provided an apparatus for cleaning a surface having charged particles of opposite polarities thereon. The apparatus includes means for removing charged particles of opposite polarities from the surface. Means are provided for attracting charged particles of opposite polarities from the removing means thereto.

Pursuant to another aspect of the present invention, there is provided an electrophotographic printing machine of the type having residual charged particles of opposite polarities adhering to a photoconductive member. The improvement includes means for removing charged particles particles of opposite polarities from the photoconductive member. Means are provided for attracting charged particles of opposite polarities from the removing means thereto.

Figure 2:
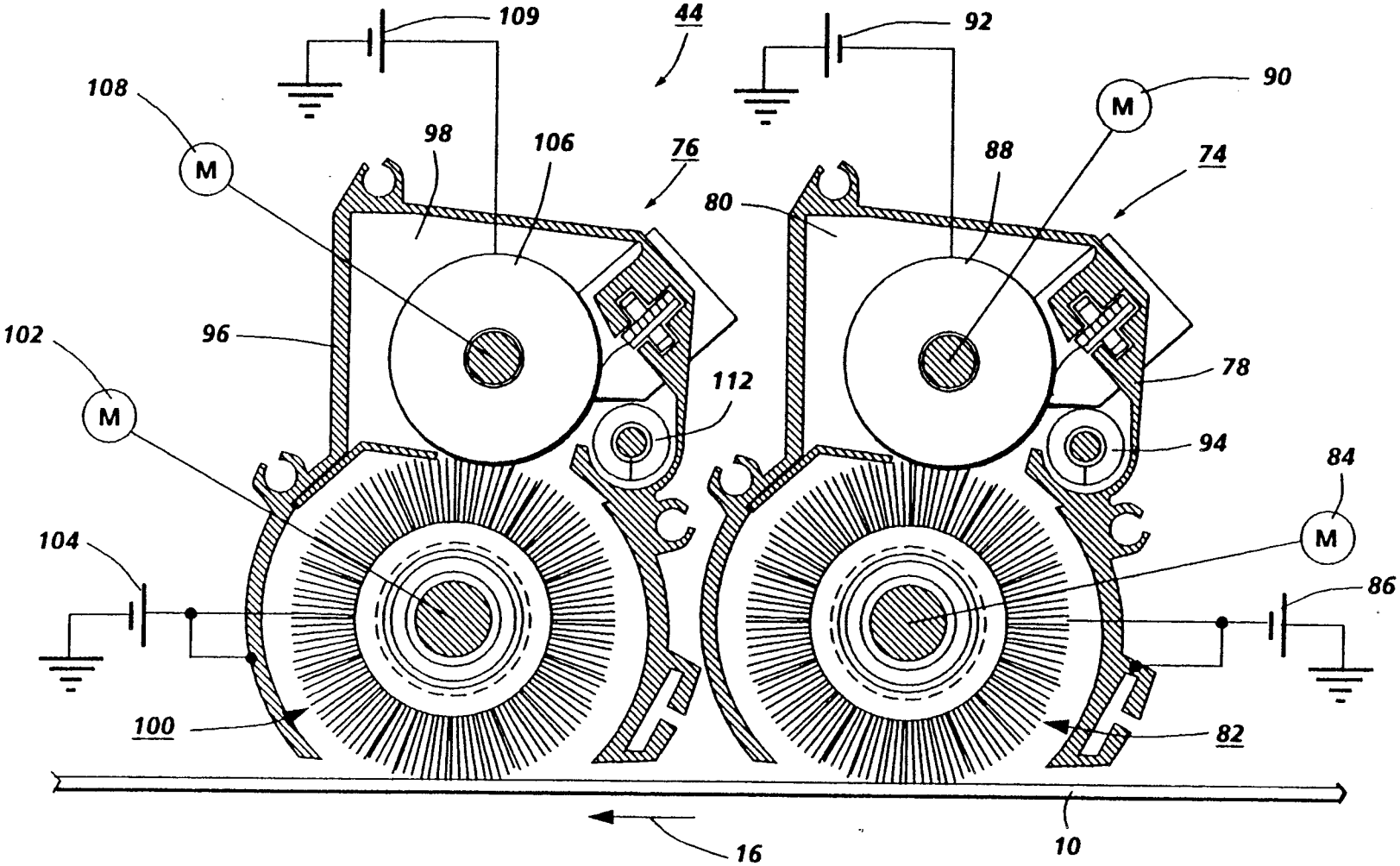

Other features of the present invention will become apparent as the following description proceeds and upon reference to the drawings, in which:

FIG. 1 is a schematic elevational view depicting an illustrative electrophotographic printing machine incorporating the features of the present invention therein; and FIG. 2 is an elevational view showing the cleaning apparatus used in the FIG. 1 printing machine.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Referring initially to FIG. 1, there is shown an illustrative electrophotographic printing machine incorporating the cleaning apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. One skilled in the art will appreciate that any suitable photoconductive material may be used in the electrophotographic printing machine. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30. By way of example, if corona generator 26 has charged the photoconductive surface to a negative potential, the electrostatic latent image will have a negative potential.

After the electrostatic latent image has been recorded on photoconductive surface 12, belt 10 advances the latent image to development station C. At development station C, a magnetic brush development system, indicated generally by the reference numeral 38, advances developer material into contact with the latent image. Preferably, magnetic brush development system 38 includes two magnetic brush developer rollers 40 and 42. Rollers 40 and 42 advance developer material into contact with the latent image. These developer rollers form a brush of carrier granules and toner particles extending outwardly therefrom. The "right sign" toner particles are positively charged while the "wrong sign" toner particles are negatively charged. The latent image attracts toner particles from the carrier granules forming a toner powder image thereon. Ideally, only the positively charged toner particles are attracted to the photoconductive surface. However, some "wrong sign" or negatively charged toner particles are also attracted to the photoconductive surface. Developer rollers 40 and 42 are mounted, at least partially, in the chamber of developer housing 44. The chamber in developer housing 44 stores a supply of developer material therein. A toner container dispenses additional toner particles into the developer material in the chamber of the developer housing as toner particles are depleted therefrom due to the development of the latent image. These fresh toner particles are mixed with the developer material in the chamber of the developer housing. Guide rollers 46 and 68 deflect belt 10 so that a portion of belt 10 is wrapped about a region of the exterior circumferential surface of rollers 40 and 42 to form extended development zones about each of the developer rollers.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48 to charge sheet 48 to a negative potential so as to attract positively charged or "right sign" toner thereto. Invariably, some residual positively and negatively charged toner particles remain adhering to photoconductive surface 12. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred toner powder image to sheet 48. Fuser assembly 60 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the positively and negatively charged residual toner particles adhering to photoconductive surface 12 are removed therefrom at cleaning station F. Cleaning station F includes a cleaning apparatus, indicated generally by the reference numeral 44 having a pair of substantially identical cleaning units 74 and 76. Cleaning unit 74 is adapted to remove positively charged particles from photoconductive surface 12 with cleaning unit 76 being adapted to remove negatively charged residual particles therefrom. Further details of cleaning apparatus 44 will be described hereinafter with reference to FIG. 2. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the cleaning apparatus of the present invention therein.

Referring now to FIG. 2, there is shown cleaning apparatus 44 in greater detail. As shown thereat, cleaning apparatus 44 includes cleaning unit 74 and cleaning unit 76. Cleaning unit 74 includes a housing 78 defining a chamber 80 having a cleaning brush, indicated generally by the reference numeral 82, disposed therein. Cleaning brush 82 includes conductive fibers extending outwardly from a cylindrical core. A constant speed motor 84 rotates the brush at a substantially constant angular velocity. Voltage source 86 applies a D.C. voltage to cleaning brush 82 and housing 78. Voltage source 86 electrically biases cleaning brush 82 and housing 78 to preferably about −400 volts. In this way, an electrical field is established between photoconductive surface 12 and brush 82 so that the positively charged residual particles adhering to photoconductive surface 12 of belt 10 are attracted to cleaning brush 82. Preferably, cleaning brush 82 is made from an aluminum core with the conductive fibers being made from a polyamide, such as Nylon, a trademark of the DuPont Corporation. The conductive fibers have a pile height of about ¾ of an inch and a pile fiber fill density of about 30,000 fibers per square inch of 7 to 25 denier per filament fibers. In operation, as the brush rotates at a constant angular velocity, the brush of conductive fibers advances into contact with photoconductive surface 12 of belt 10. The positively charged particles adhering to belt 10 are attracted to the conductive fibers of cleaning brush 82. Roller 88 is positioned closely adjacent to cleaning brush 82. A constant speed motor 90 rotates roller 88. As roller 88 rotates, it attracts the particles from the conductive fibers of cleaning brush 82. Voltage source 92 is connected to roller 88 and applies a D.C. voltage preferably of about −650 volts thereon. The magnitude of the electrical bias applied by voltage source 92 to roller 88 is greater than the electrical bias applied by voltage source 86 to the conductive fibers of cleaning brush 82. Preferably, roller 88 is made from aluminum having a coating of aluminum oxide thereon. A blade is positioned closely adjacent to roller 88 to remove the positively charged particles therefrom. The particles removed from roller 88 are received by a helical auger 94. Helical auger 94 removes the particles from the cleaning apparatus.

With continued reference to FIG. 2, cleaning unit 76 is adapted to remove the negatively charged particles from belt 10. Cleaning unit 76 includes a housing 96 defining a chamber 98 having a cleaning brush, indicated generally by the reference numeral 100, disposed therein. Cleaning brush 100 includes conductive fibers extending outwardly from a cylindrical core. A constant speed motor 102 rotates the brush at a substantially constant angular velocity. Voltage source 104 applies a D.C. voltage to cleaning brush 100 and housing 96. Voltage source 104 electrically biases cleaning brush 100 and housing 96 to preferably about +300 volts. In this way, an electrical field is established between photoconductive surface 12 and brush 100 so that the negatively charged residual particles adhering to photoconductive surface 12 of belt 10 are attracted to cleaning brush 82. Preferably, cleaning brush 82 is made from an aluminum core with the conductive fibers being made from a polyamide, such as Nylon, a trademark of the DuPont Corporation. The conductive fibers have a pile height of about ¾ of an inch and a pile fiber fill density of about 30,000 fibers per square inch of 7 to 25 denier per filament fibers. In operation, as the brush rotates at a constant angular velocity, the brush of conductive fibers advances into contact with photoconductive surface 12 of belt 10. The negatively charged particles adhering to belt 10 are attracted to the conductive fibers of cleaning brush 100. Roller 106 is positioned closely adjacent to cleaning brush 100. A constant speed motor 108 rotates roller 106. As roller 106 rotates, it attracts the particles from the conductive fibers of cleaning brush 100. Voltage source 109 is connected to roller 106 and applies a D. C. voltage preferably of about +550 volts thereon. The magnitude of the electrical bias applied by voltage source 109 to roller 106 is greater than the electrical bias applied by voltage source 104 to the conductive fibers of cleaning brush 100. Preferably, roller 106 is made from aluminum having a coating of aluminum oxide thereon. A blade is positioned closely adjacent to roller 88 to remove the positively charged particles therefrom. The particles removed from roller 106 are received by a helical auger 112. Helical auger 112 removes the particles from the cleaning apparatus. Cleaning units of this type are described in U.S. Pat. No. 4,706,320 issued to Swift in 1987, and U.S. Pat. No. 4,741,942 issued to Swift in 1988, the relevant portions thereof being hereby incorporated into the present application.

One skilled in the art will appreciate that magnetic brush cleaning rollers may be used in place of cleaning brushes. The magnetic cleaning brushes uses a sleeve rotating about a magnet disposed interiorly thereof. Carrier granules adhere to the sleeve and attract residual toner particles from the photoconductive surface thereto. The magnetic brush cleaning rollers are electrically biased in the same manner as the cleaning brushes.

In recapitulation, it is evident that the cleaning apparatus of the present invention includes two substantially identical cleaning units. One cleaning unit is electrically biased to remove positive particles from the photoconductive surface with the other cleaning unit being adapted to remove negative particles therefrom. In this way, the cleaning apparatus removes both "right sign" and "wrong sign" toner particles from the photoconductive belt. Each cleaning unit includes a cleaning brush to attract particles from the photoconductive belt. These particles are then attracted from the cleaning brush to a roller. A blade removes the particles from the roller and an auger transports the particles away from the cleaning apparatus.

It is, therefore, apparent that there has been provided in accordance with the present invention, a cleaning apparatus that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An electrophotographic printing machine of the type having residual charged particles of opposite polarities adhering to a photoconductive member, wherein the improvement includes:

a first cleaning unit comprising a first housing defining a chamber, a first brush, positioned at least partially in the chamber of said first housing, having a multiplicity of conductive fibers extending outwardly therefrom, first brush biasing means for electrically biasing said first brush to a first magnitude and first polarity to remove particles having one polarity from the photoconductive member, said first brush biasing means electrically biasing said first housing to the same magnitude and polarity as said first brush, a first detoning roll positioned adjacent said first brush in the chamber of said first housing, and first roll biasing means for electrically biasing said first detoning roll to a magnitude and polarity sufficient to attract the particles having the one polarity from the conductive fibers of said first brush to said first detoning roll; and a second cleaning unit, adjacent said first cleaning unit, comprising a second housing defining a chamber, a second brush, positioned at least partially in the chamber of said second housing, having a multiplicity of conductive fibers extending outwardly therefrom, second brush biasing means for electrically biasing said second brush to a second magnitude and second polarity, opposite in polarity to the first polarity, to remove particles having the other polarity from the photoconductive member, said second brush biasing means electrically biasing said second housing to the same magnitude and polarity as said second brush, a second detoning roll positioned adjacent said second brush in the chamber of said second housing, and second roll biasing means for electrically biasing said second detoning roll to a magnitude and polarity sufficient to attract the particles having the the other polarity from the conductive fibers of said second brush to said second detoning roll.

* * * * *